US012673252B2

(12) United States Patent
Scott

(10) Patent No.: US 12,673,252 B2
(45) Date of Patent: Jul. 7, 2026

(54) SKATE BLADE PROTECTORS

(71) Applicant: SHARP STEP, INC., Hamburg, NY (US)

(72) Inventor: Donovan Scott, Hamburg, NY (US)

(73) Assignee: Sharp Step, Inc., Hamburg, NY (US)

( * ) Notice: Subject to any disclaimer, the term of this patent is extended or adjusted under 35 U.S.C. 154(b) by 0 days.

(21) Appl. No.: 19/410,159

(22) Filed: Dec. 5, 2025

(65) Prior Publication Data

US 2026/0158362 A1 Jun. 11, 2026

Related U.S. Application Data

(60) Provisional application No. 63/728,198, filed on Dec. 5, 2024.

(51) Int. Cl.
*A63C 3/12* (2006.01)

(52) U.S. Cl.
CPC ..... *A63C 3/12* (2013.01)

(58) Field of Classification Search
CPC ..... A63C 3/12; A63C 17/002; A63C 3/10
See application file for complete search history.

(56) References Cited

U.S. PATENT DOCUMENTS 1,210,224 A * 12/1916 Silk ..... A63C 3/12 280/825
3,135,526 A 6/1964 Johns
3,338,588 A 8/1967 Couture
3,583,720 A 6/1971 Fowlkes
4,264,090 A 4/1981 Davies
4,382,615 A 5/1983 Groenborg et al.
4,382,616 A 5/1983 Olivieri
4,392,674 A 7/1983 Evon
5,513,881 A 5/1996 DiMeglio et al.
5,594,966 A * 1/1997 Goldman ..... A45D 26/0066 451/523
5,765,870 A * 6/1998 Riley ..... A63C 17/002 280/825
5,941,568 A 8/1999 White, II
6,193,277 B1 * 2/2001 Marasco ..... A63C 17/20 280/809
6,312,017 B1 * 11/2001 Hardwick ..... A63C 3/10 451/558
D574,458 S 8/2008 Mayer et al.
(Continued)

FOREIGN PATENT DOCUMENTS

BR MU8800458 U2 * 3/2010
CH 621080 A5 * 1/1981 ..... B24D 15/08
(Continued)

OTHER PUBLICATIONS

FI-129021-B English Translation (Year: 2021).*
(Continued)

*Primary Examiner* — Michael T. Walsh
(74) *Attorney, Agent, or Firm* — Mertzlufft Law PLLC; Joshua D. Mertzlufft

(57) ABSTRACT

A skate blade protector may include an outer shell, an inner shell configured to receive a skate blade of a skate, a magnet disposed therebetween, and a sharpening agent disposed on the inner shell such that when the inner shell receives the skate blade, the sharpening agent contacts the skate blade.

18 Claims, 6 Drawing Sheets

(56) References Cited

U.S. PATENT DOCUMENTS

| | | | | |
|---|---|---|---|---|
| 8,007,006 | B2 * | 8/2011 | Damiano | A63C 3/12 280/825 |
| 8,382,161 | B2 | 2/2013 | Mayer et al. | |
| 8,414,030 | B2 | 4/2013 | Hirano et al. | |
| 8,646,809 | B2 | 2/2014 | Lee | |
| 8,764,065 | B2 * | 7/2014 | Kimball | A63C 17/002 280/811 |
| 11,660,523 | B2 | 5/2023 | Merlo | |
| 12,370,432 | B2 | 7/2025 | Sinek | |

FOREIGN PATENT DOCUMENTS

| | | | | |
|---|---|---|---|---|
| CN | 221601212 | | 8/2024 | |
| DE | 102009037298 | A1 * | 2/2011 | B23D 63/08 |
| FI | 129021 | | 5/2021 | |
| FI | 129021 | B * | 5/2021 | A63C 3/12 |
| KR | 200473464 | | 7/2014 | |
| KR | 200473469 | | 7/2014 | |
| WO | WO-2009018994 | A1 * | 2/2009 | B24D 15/10 |
| WO | 2017184069 | | 10/2017 | |

OTHER PUBLICATIONS

BR-MU8800458-U2 English Translation (Year: 2010).*
CH-621080-A5 English Translation (Year: 1981).*
DE-102009037298-A1 English Translation (Year: 2011).*
WO-2009018994-A1 English Translation (Year: 2009).*
Osolady Store, Skate Protector Safety Razor Finger Protector Guard Magnetic Knuckle Holder Sheaths One Charger Belt, Aug. 19, 2025.

* cited by examiner

SKATE BLADE PROTECTORS

CROSS-REFERENCE TO RELATED APPLICATIONS

This application claims priority to U.S. Provisional Application No. 63/728,198, filed on Dec. 5, 2024, the entire disclosure of which is hereby incorporated by reference.

BACKGROUND

Ice skates, such as hockey skates or figure skates, are engineered equipment, designed to provide athletes with optimal performance on the ice. The construction of ice skates includes a boot, a blade holder, and a blade. The boot may be made from synthetic materials or composites that offer a combination of rigidity and comfort, essential for both protection and mobility. The blade holder secures the blade to the boot. In some instances, the blade holder and the blade are integral or monolithic. The blades themselves are conventionally constructed of a metal such as stainless steel. Sharpness of the blades provides a skater balance between speed, stability, and maneuverability in ice skating activities (e.g., hockey, figure skating, recreational skating).

SUMMARY

This Summary is intended to introduce, in an abbreviated form, various topics to be elaborated upon below in the Detailed Description. This Summary is not intended to identify key or essential aspects of the claimed invention. This Summary is similarly not intended for use as an aid in determining the scope of the claims.

In some aspects, the techniques described herein relate to a skate blade protector, including: an outer shell; an inner shell disposed at least partially within an extent of the outer shell and configured to receive a skate blade of a skate; and a sharpening agent disposed on the inner shell such that when the inner shell receives the skate blade, the sharpening agent contacts the skate blade.

In some aspects, the techniques described herein relate to a skate blade protector, further including a magnet disposed between the outer shell and the inner shell.

In some aspects, the techniques described herein relate to a skate blade protector, further including a strap secured to the outer shell and configured to wrap around a boot of the skate.

In some aspects, the techniques described herein relate to a skate blade protector, wherein the strap includes an elastic material.

In some aspects, the techniques described herein relate to a skate blade protector, wherein the inner shell and the outer shell are further defined by a vent hole passage therethrough.

In some aspects, the techniques described herein relate to a skate blade protector, wherein the inner shell includes woven nylon.

In some aspects, the techniques described herein relate to a skate blade protector, wherein the outer shell includes a polymer.

In some aspects, the techniques described herein relate to a skate blade protector, wherein the sharpening agent is configured to remove oxidation from the skate blade.

In some aspects, the techniques described herein relate to a skate blade protector, wherein the sharpening agent includes an abrasive material.

In some aspects, the techniques described herein relate to a skate blade protector, wherein the sharpening agent includes aluminum oxide.

In some aspects, the techniques described herein relate to a skate blade protector, including: an outer shell; an inner shell disposed at least partially within an extent of the outer shell and configured to receive a skate blade of a skate; a magnet disposed between the outer shell and the inner shell; a sharpening agent disposed on the inner shell such that when the inner shell receives the skate blade, the sharpening agent contacts the skate blade; and a strap secured to the outer shell and configured to wrap around a boot of the skate; wherein the inner shell and the outer shell are further defined by a vent hole passage therethrough.

In some aspects, the techniques described herein relate to a skate blade protector, wherein the strap includes an elastic material.

In some aspects, the techniques described herein relate to a skate blade protector, wherein the inner shell includes woven nylon.

In some aspects, the techniques described herein relate to a skate blade protector, wherein the outer shell includes a polymer.

In some aspects, the techniques described herein relate to a skate blade protector, wherein the sharpening agent is configured to remove oxidation from the skate blade.

In some aspects, the techniques described herein relate to a skate blade protector, wherein the sharpening agent includes an abrasive material.

In some aspects, the techniques described herein relate to a skate blade protector, wherein the sharpening agent includes aluminum oxide.

In some aspects, the techniques described herein relate to a method of using a skate blade protector, including: providing the skate blade protector, including: an outer shell; an inner shell disposed at least partially within an extent of the outer shell and configured to receive a skate blade of a skate; and a sharpening agent disposed on the inner shell such that when the inner shell receives the skate blade, the sharpening agent contacts the skate blade installing a skate blade of a skate into the inner shell such that the sharpening agent contacts the skate blade.

BRIEF DESCRIPTION OF THE FIGURES

For a fuller understanding of the nature and objects of the disclosure, reference should be made to the following detailed description taken in conjunction with the accompanying drawings, in which.

DETAILED DESCRIPTION

Figure 1:
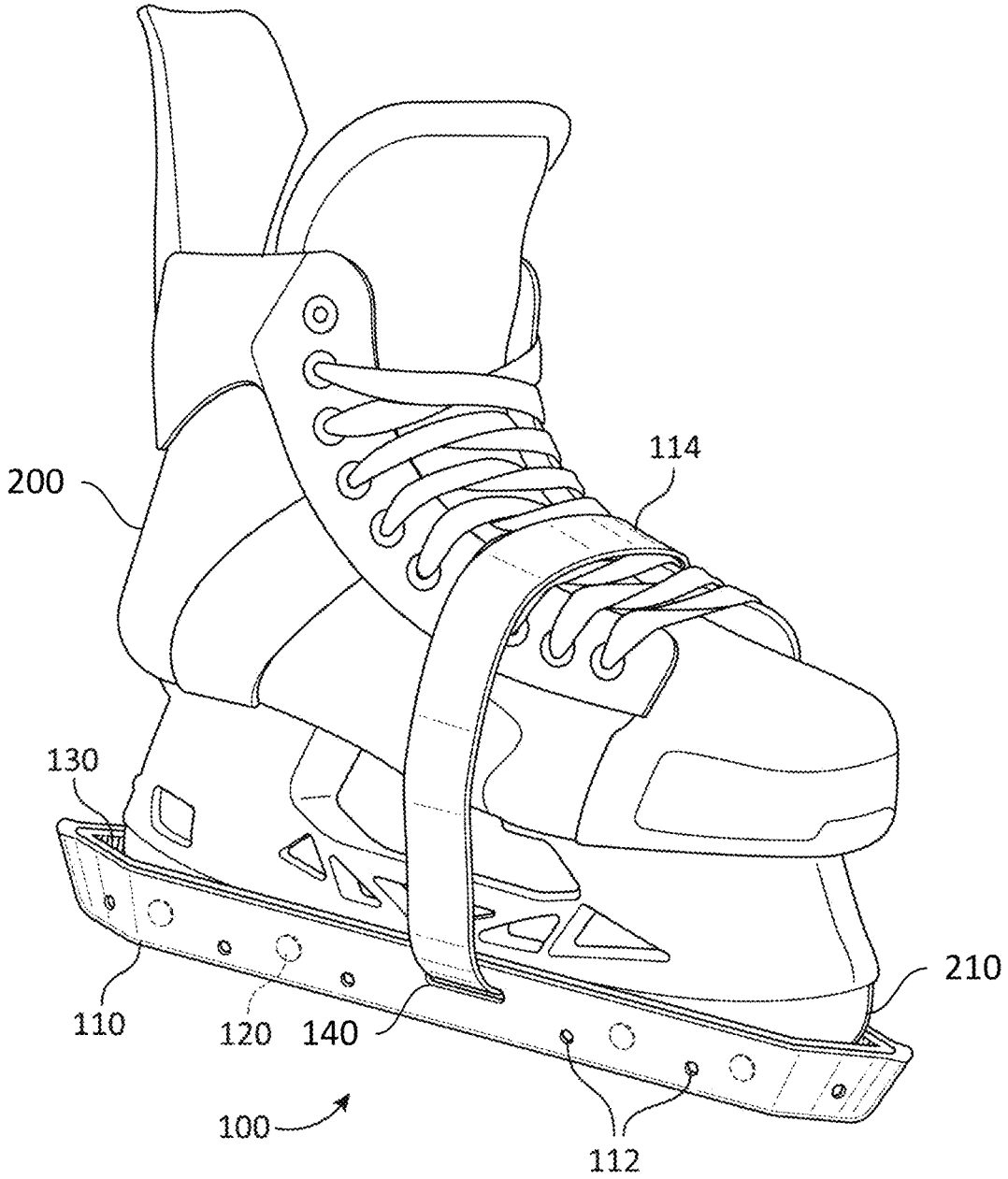
FIG. 1 illustrates a skate blade protector installed on a skate, according to one or more implementations herein.

Implementations disclosed herein include systems for protecting skate blades while providing passive sharpening and methods of making and using the same.

Implementations disclosed herein solve the problem of dulling or fouled skate blades. This problem exists because as skates are used by a skater, the blades dull due to tribological effects of ice and its contents over time, as well as contact with other surfaces such as flooring. Skate blades may foul as the buildup of rust, salts, minerals, or other debris or chemicals accumulates on the blade. Both the effects of fouling and dulling degrade the performance of the skate blade, thereby degrading the safety, stability, maneuverability, and speed of the skater.

Sharp blades provide for superior edge retention and ice engagement than dull blades. Sharp blades feature a finely honed edge that allows for greater bite into the ice surface, reducing slippage and providing enhanced control during rapid movements. This increased edge grip provides advantages to a skater when executing tight turns, quick stops, and powerful strides. Dull blades have rounded edges due to wear, and accordingly fail to penetrate the ice effectively, leading to decreased traction and compromised agility. As such, dull blades may negatively impact a skater's ability to skate.

Furthermore, sharp blades improve the efficiency of energy transfer from the skater to the ice, resulting in more powerful and efficient strides. The honed edge of a sharp blade minimizes the energy loss that occurs when a blade slips or skids on the ice surface. This means that skaters can generate more speed with less effort, conserving their energy for longer periods of play. In contrast, dull blades create additional friction and resistance, requiring greater physical exertion by the skater to achieve the same level of performance. Therefore, maintaining sharp blades is essential for both the technical execution and endurance of skaters, ultimately contributing to their overall effectiveness on the ice.

Conventional skate blade sharpening involves the use of grinding wheels or grinding blocks to hone the edge of a blade. This honing may be performed before each use, on a regular basis, or otherwise when a skater believes it desirable to sharpen their skate blades (e.g., when the player begins to feel the effects of dulling skate blades. In any event, such a method of skate blade sharpening requires the use of specialized equipment, such as a grinding wheel, to which many skaters do not have free access. Also, a manually-sharpened skate blade edge may include a variety of irregularities and depends highly on the skill of the person doing the sharpening.

Furthermore, such conventional means of sharpening skate blades may provide for dangers or hazards when in use. For example, a powered grinding wheel may generate significant sparks and dust when in normal use, creating both health and fire hazards for the operator.

Implementations disclosed herein solve all or some of these shortcomings. Implementations disclosed herein include skate blade protectors comprising an outer shell, an inner shell configured to receive a skate blade of a skate, a magnet disposed therebetween, and a sharpening agent disposed on the inner shell such that when the inner shell receives the skate blade, the sharpening agent contacts the skate blade.

FIG. 1 illustrates a skate blade protector 100 installed on a skate 200, according to one or more implementations herein. The skate blade protector 100 may provide for passive sharpening of a skate blade 210 when installed on the skate 200, for example, by inclusion of an abrasive material suitable to hone the skate blade 210 due to contact or wear as a result of forces applied to the blade (e.g., while the skater is walking with the skate blade protector 100 installed on the skate 200.

The skate blade protector 100 may include an outer shell 110 and an inner shell 130. The outer shell 110 may comprise, for example, a rigid or semi-rigid material such a polymer or metal and may provide structural integrity to the skate blade protector 100.

The inner shell 130 may be disposed at least partially or completely within the extents of the outer shell 110 and may be itself sized and configured to receive at least part of a skate blade 210 of a skate 200. The inner shell 130 may comprise, for example, a material suitable to not be damaged by the skate blade 210, but sufficiently pliable in some implementations to conform to the skate blade 210 such that the skate blade centers proximate a centerline of the skate blade protector 100. For example, the inner shell 130 may include woven nylon.

While the skate blade protector 100 is illustrated in FIG. 1 such that the outer shell 110 and inner shell 130 are configured such that the inner shell 130 does not wrap around or conform to a curved end of the skate blade 210, this is for example purposes only, and to assist the reader to understand the location within the outer shell of the inner shell. It will be understood that in implementations according to the present disclosure the skate blade protector 100 may be configured such that either or both ends of the outer shell 110 or inner shell 130 conform to or wrap around the end geometry of the skate blade 210. For example, a hockey skate, as illustrated in FIG. 1 for example purposes, has a skate blade terminating in both ends having a curvature, and the skate blade protector 100 may conform as such. In another example, a figure skate may include a brake on one or both ends, and the skate blade protector 100 may conform to the figure skate blade having the brake.

In some implementations, disposed between the outer shell 110 and the inner shell 130 may be one or more magnets 120. The magnets may be fixedly secured to one or more of the outer shell 110 or the inner shell 130, for example, using an adhesive or a press fit. In other implementations, the magnets 120 may be integral with (e.g., cast into) one or more of the outer shell 110 or the inner shell 130. In yet further implementations, the outer shell 110 or the inner shell 130 may comprise the magnets 120 in by being constructed of a magnetic material.

In some implementations, one or more vents 112 may pass through one or both of the outer shell 110 or inner shell 130. The vents 112 may enable venting, airflow, or drainage of fluids to and from the skate blade when installed.

In some implementations, the outer shell 110 may include one or more strap holes 140. The strap holes may in some implementations further pass through the inner shell 130. The strap holes 140 may provide for securing of a strap 114 to the skate blade protector 100. The strap 114 may be used to secure the skate blade protector 100 to the skate 200. The strap 114 may comprise an elastic material and may in some implementations be adjustable to fit different skate boot sizes. The strap 114 may include a fastening segment. The fastening segment may include a securing apparatus to complete a loop around (e.g., wrap around) a skate boot. The securing apparatus may, in some implementations, include a hook-and-loop fastening system. It will be understood that, in some implementations, the skate blade protector 100 may omit the strap 114 to be secured to a skate blade only by the magnets 120 or a fit of the skate blade protector 100 to the skate blade 210.

When the skate blade protector 100 is installed on a skate blade, the sharpening agent may sharpen or clean the skate blade. For example, by storing a skate blade 210 with a skate blade protector 100 installed or walking on a skate 200 with a skate blade protector 100 installed, the sharpening agent may clean or ablate the skate blade 210. In this way, the skate blade protector 100 may remove material, rust, or oxidative buildup from the skate blade while sharpening the skate blade. The magnets 120 may, when present, further function to attract ferrous residue and particles removed from the blade during or following cleaning.

Figure 2:
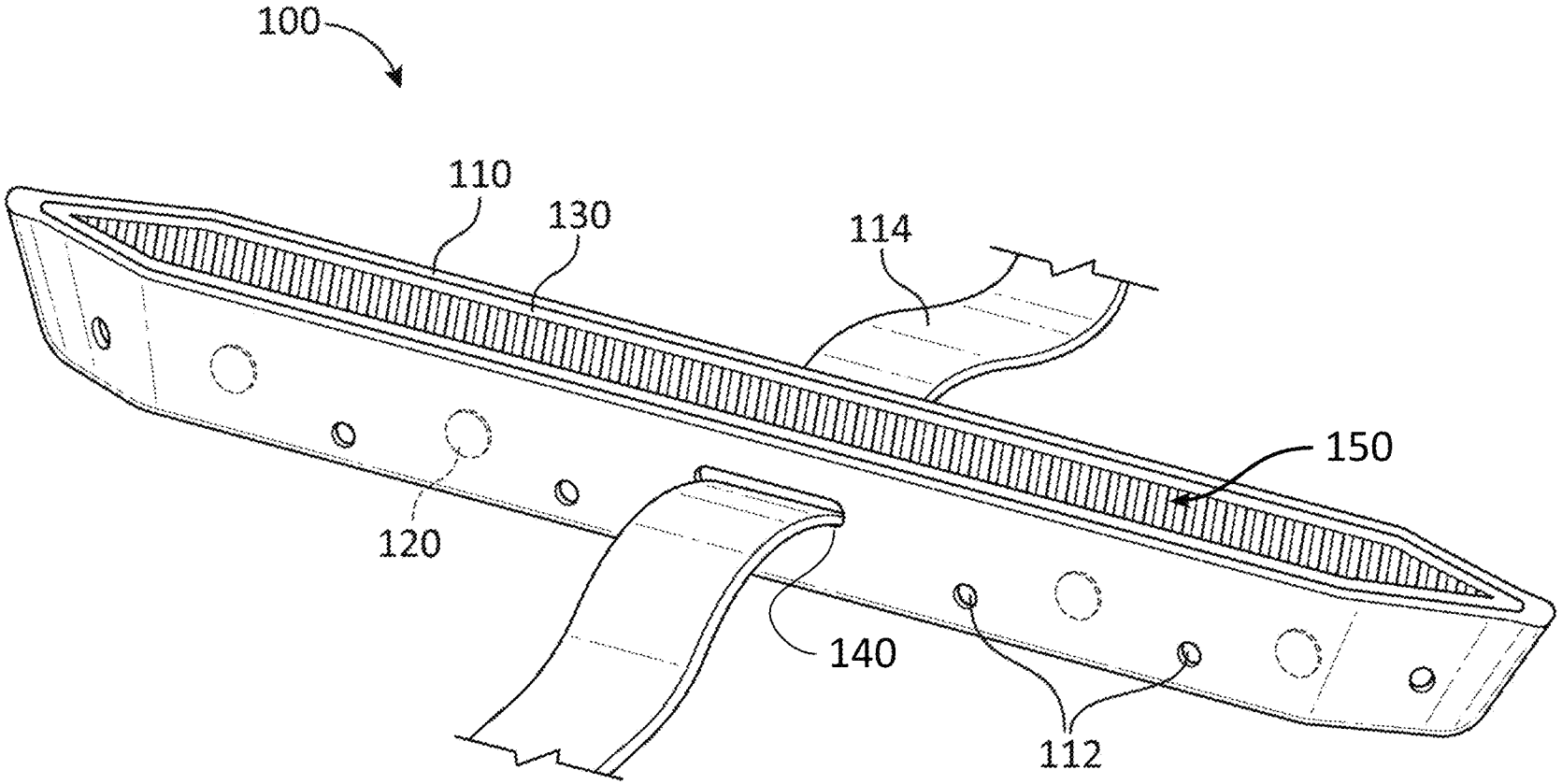
FIG. 2 illustrates the skate blade protector, according to one or more implementations herein.

FIG. 2 illustrates the skate blade protector 100, according to one or more implementations herein. Particularly, FIG. 2 illustrates a location of the inner shell 130 in relation to the outer shell 110. In some implementations, as illustrated in FIG. 2, the inner shell 130 may be disposed entirely with the extents of the outer shell 110. It will be understood that in other implementations, the inner shell 130 may extend past the extents of the outer shell 110 such that a portion of the inner shell 130 is disposed within the extents of the outer shell 110 and a portion of the inner shell 130 is disposed without the extents of the outer shell 110. Thus, the inner shell 130 may be at least partially disposed within the extents of the outer shell 110.

The inner shell 130 may have disposed thereon a deposition 150 of a sharpening agent configured to ablate or chemically clean the blade of a skate when the skate blade protector is installed on the skate. The sharpening agent may include, for example, and abrasive material. In some implementations, the sharpening agent may include aluminum oxide ($Al_2O_3$).

The sharpening agent's dual function of ablation and chemical cleaning may provide for the passive sharpening and maintenance capabilities of the skate blade protector 100. Mechanically, the abrasive particles within the sharpening agent—such as aluminum oxide or other suitable materials—act as a fine honing surface. When the skate blade 210 is inserted into the inner shell 130 and subjected to relative movement (e.g., from a user walking, or simple vibration/shifting during storage), these abrasive particles physically ablate microscopic amounts of material from the blade's running edge and sides. This controlled abrasion works to smooth irregularities, remove small nicks, and re-establish a finely honed edge profile, thereby counteracting the dulling effects of use. The pressure exerted on the blade by the inner shell, which may in various implementations be aided by the magnetic attraction of the magnets 120, a strap 114, or the fit of the skate blade protector 100 to the skate blade 210, may enhance contact between the blade and the sharpening agent deposition 150 for this process to occur effectively and uniformly along the length of the blade.

Concurrently, the sharpening agent also performs a chemical cleaning action. Stainless steel skate blades are susceptible to oxidation, or rust, especially when exposed to moisture (e.g., melted ice) and mineral- or salt-containing water, and then stored improperly. This oxidative buildup compromises the integrity and sharpness of the blade edge. The chemical composition of the sharpening agent, or additives embedded within it, are configured to react with and remove this ferrous oxidation. While the abrasive action physically breaks up larger rust deposits, the chemical component dissolves or chemically alters the tightly bound oxidative layer. For instance, the fine particles of aluminum oxide, or other components of the deposition 150, may exhibit mild chemical reactivity or may be formulated to include agents that preferentially attack the iron oxide (rust) without significantly corroding the base steel of the blade.

The inventor found the synergistic effect of ablation and chemical cleaning provides for comprehensive blade maintenance. The mechanical abrasion removes dulling material and sharpens the edge, while the chemical cleaning specifically targets and eliminates oxidation and corrosive byproducts. This continuous, passive process, activated by storing or transporting a skate with the skate blade protector installed, ensures that the skate blade remains free of rust and maintains a superior level of sharpness and edge retention compared to a blade stored without such a protector. Furthermore, the action of the magnets 120, in some implementations, attracting any ferrous debris—including rust particles and fine steel shavings ablated during the process—may aid in keeping the blade and the internal cavity of the protector cleaner.

The sharpening agent within the deposition 150 is not limited to aluminum oxide; alternative materials with suitable abrasive and/or chemical properties may be employed themselves or in a combination with aluminum oxide and other agents to enhance passive sharpening and cleaning of the skate blade. One such alternative is silicon carbide (SIC), a compound known for its extreme hardness and sharpness, which is typically harder than aluminum oxide. Silicon carbide particles, when embedded in the inner shell 130, may provide a very aggressive mechanical abrasion that can rapidly re-establish a sharp edge profile. SiC is particularly effective at cutting through both steel and minor contaminants. The material can be utilized in various grit sizes, allowing the protector's sharpening effect to be tuned from an aggressive initial honing to a finer, maintenance-level polish. Due to its crystalline structure, SiC tends to fracture during use, creating new sharp edges, which maintains its cutting efficiency over a longer service life compared to some other abrasives.

Another suitable sharpening agent that may be used itself or in combination with others is cubic boron nitride (CBN), which is second only to diamond in terms of hardness, which may also be included in the sharpening agent (e.g., industrial diamond, diamond dust). While more costly, CBN offers superior thermal stability and toughness, making it an excellent abrasive for high-performance applications. For the skate blade protector, CBN particles may provide exceptional edge-holding capabilities and longevity. When deposited on the inner shell 130 as a sharpening agent or a component thereof, CBN ensures a very fine and consistent honing action. Furthermore, its chemical inertness minimizes any potential adverse reactions with the stainless steel of the skate blade, focusing purely on mechanical removal of material and surface irregularities. This inertness and extreme hardness enable CBN to provide for maintaining the integrity and sharpness of high-end skate blades with minimal material removal over time.

Figure 3:
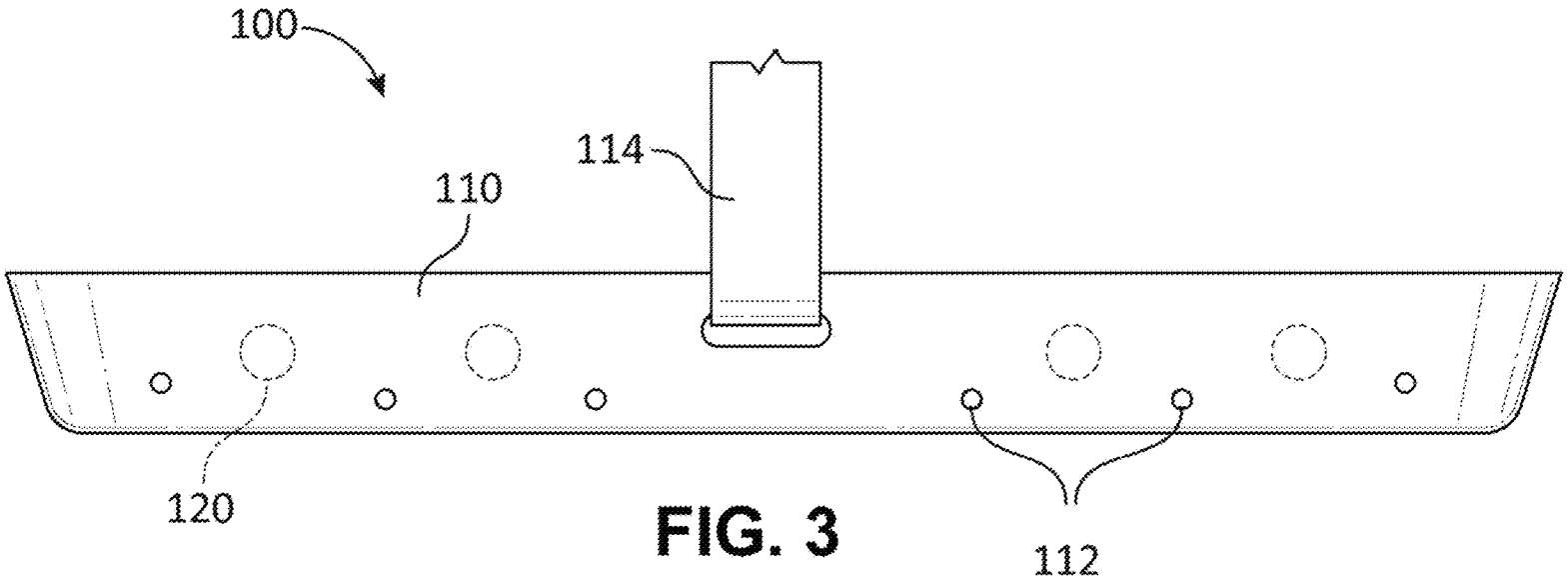
FIG. 3 illustrates a side view of the skate blade protector, according to one or more implementations herein.

FIG. 3 illustrates a side view of the skate blade protector 100, according to one or more implementations herein. In an implementation including the magnets 120, the magnets may be disposed at intervals between the outer shell 110 and the inner shell 130. This may both secure the position of the magnets 120 relative to the skate blade protector 100 and protect the magnets 120 from corrosive or other damaging effects.

Figure 4:
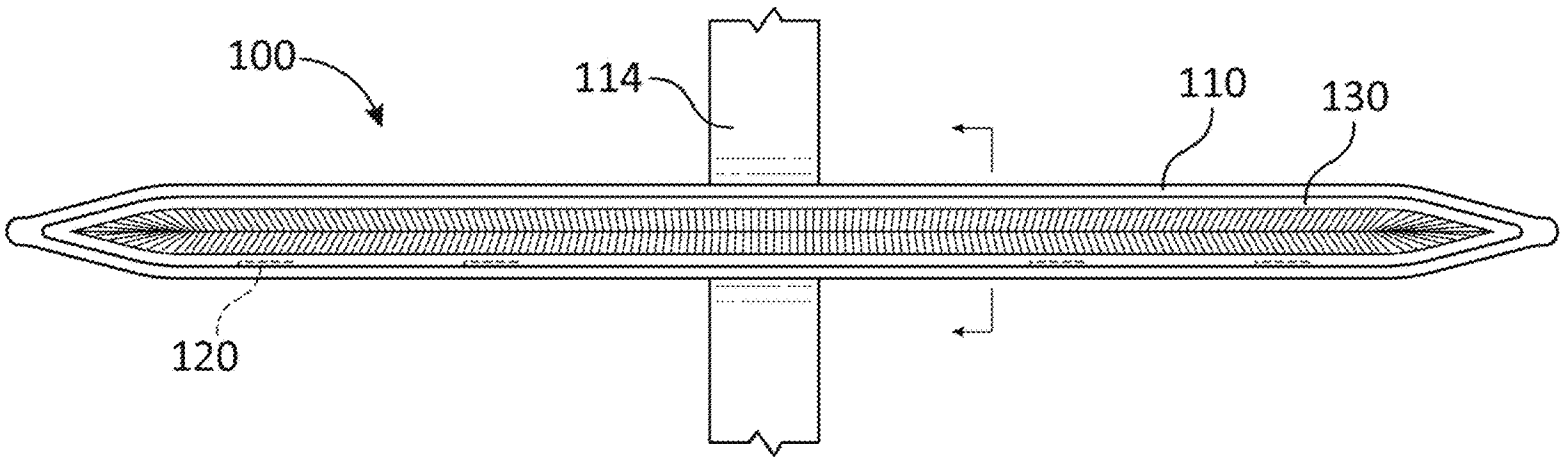
FIG. 4 illustrates a top view of the skate blade protector, according to one or more implementations herein.

FIG. 4 illustrates a top view of the skate blade protector 100, according to one or more implementations herein. The skate blade protector 100 may be of an elongated shape configured to fit or conform to a portion of a skate blade. In some implementations, the ends of the sidewalls of the outer shell 110 and the inner shell 130 may terminate together with their mirrored counterparts at the ends thereof to provide for simplicity of manufacture.

Figure 5:
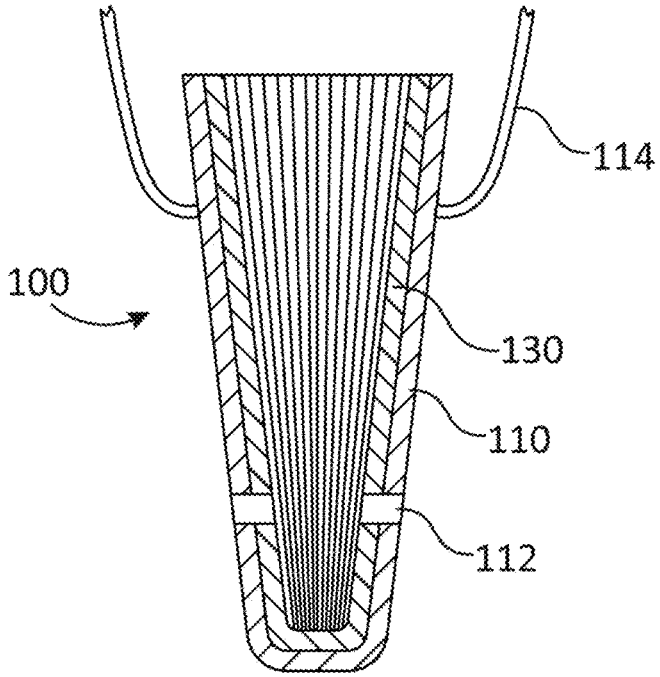
FIG. 5 illustrates a cross-section view of the skate blade protector, according to one or more implementations herein.

FIG. 5 illustrates a cross-section view of the skate blade protector 100, according to one or more implementations herein. The vents 112 may be passages through either or both of the outer shell 110 and the inner shell 130, thus forming vent hole passages therethrough. These vents 112 may permit weepage or draining of unwanted melted fluids from the inner volume of the inner shell 130, for example, as ice melts from a skate blade or fluids drip off. The vents 112 may be positioned to provide for structural integrity of the skate blade protector 100, or may be positioned to maximize drainage capability. In some implementations, the vents 112 are disposed in the sidewalls of the skate blade protector 100, and in other implementations, the vents 112 are disposed proximate the bottom of the skate blade protector.

Figure 6:
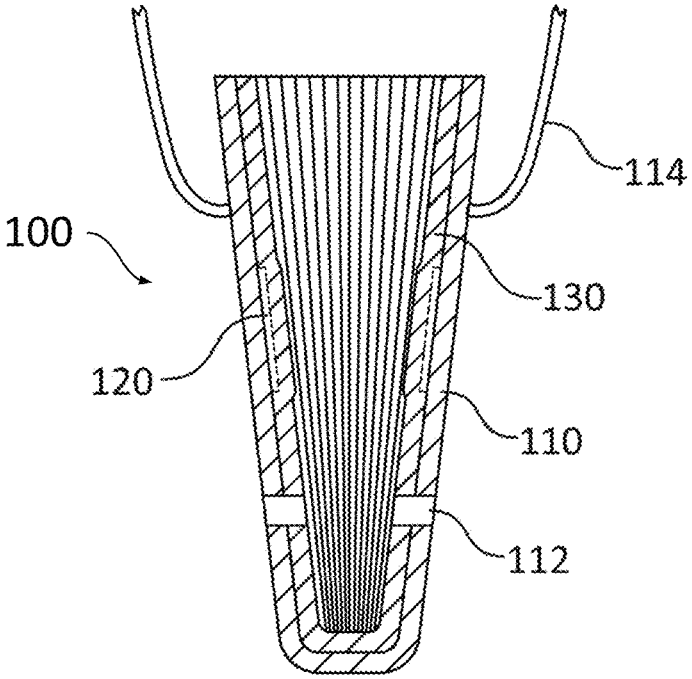
FIG. 6 illustrates a cross-section view of the skate blade protector, according to one or more implementations herein.

FIG. 6 illustrates a cross-section view of the skate blade protector 100, according to one or more implementations herein. In implementations including magnets 120, the magnets 120 may be disposed between the outer shell 110 and the inner shell 130.

The configuration wherein the magnets 120 are disposed between the outer shell 110 and the inner shell 130 may further enhance the skate blade protector's functionality, durability, and operational security. This placement may leverage the magnetic field for blade retention while simultaneously providing physical and environmental protection for the magnetic components, thereby extending the service life of the skate blade protector 100 and enhancing its efficacy.

By embedding the magnets 120 between the shells, the magnetic field is strategically projected inward through the material of the inner shell 130 to the interior cavity. This arrangement provides for a magnetic coupling force to hold the skate blade 210 firmly against the sharpening agent deposition 150. This constant, moderate pressure may provide consistent and maximal contact, allowing the passive abrasive and chemical cleaning actions of the sharpening agent to occur effectively during user activities such as transport or walking and a reliable, non-mechanical securing means, which may prevent the blade from accidentally dislodging. The interstitial placement provides for the magnetic force to be applied at the blade interface without the magnets 120 themselves being in direct contact with the blade.

The following figures illustrate example methods and operations thereof. In some implementations, a method illustrated herein may include additional operations, fewer operations, differently arranged operations, or different operations than the operations depicted in the following figures. Moreover, or in the alternative, two or more of the operations depicted in the following figures may be performed at least partially in parallel.

Figure 7:
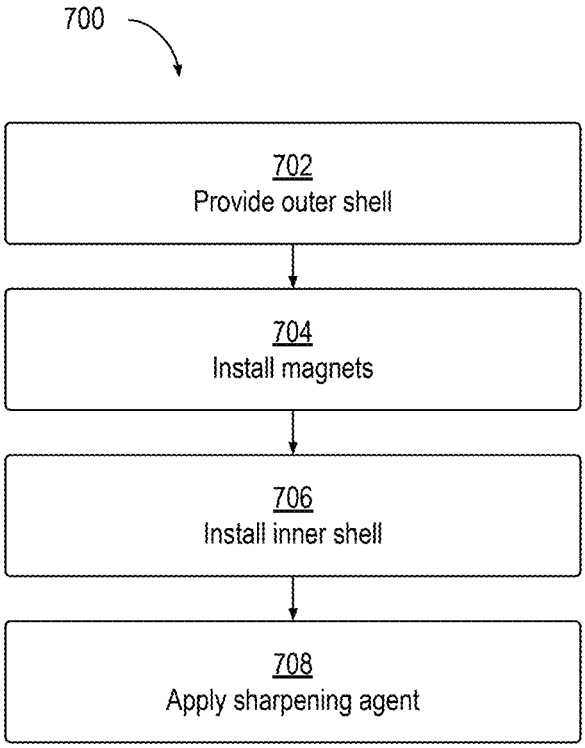
FIG. 7 is a flowchart illustrating an example method of making a skate blade protector, according to one or more implementations herein.

FIG. 7 is a flowchart illustrating an example method 700, according to one or more implementations herein. In some implementations, one or more operations illustrated in FIG. 7 may be performed by one or more of the devices or components depicted in FIG. 1 through FIG. 6, in concert, in the alternative, or in combinations thereof. In some implementations, one or more operations may be performed by another device, system, or group of devices or systems separate from or including these. Additionally, or alternatively other devices, components, or systems, may be employed to perform the operations.

An operation 702 may include providing an outer shell and may be performed alone or in combination with one or more other operations depicted in FIG. 7. The outer shell may be made, for example, using injection molding, punch die, custom cutting or another plastic-forming method.

An operation 704 may include installing a magnet within extents of the outer shell and may be performed alone or in combination with one or more other operations depicted in FIG. 7. The magnet may be installed using, for example, an adhesive, or may be molded into the outer or inner shell.

An operation 706 may include installing an inner shell within the extents of the outer shell such that the magnet is disposed between the inner shell and the outer shell and may be performed alone or in combination with one or more other operations depicted in FIG. 7. The inner shell may be formed by, for example, heat-sealing, stitching, adhesive bonding, or another fabric joining method.

An operation 708 may include applying a sharpening agent within extents of the inner shell and may be performed alone or in combination with one or more other operations depicted in FIG. 7.

Figure 8:
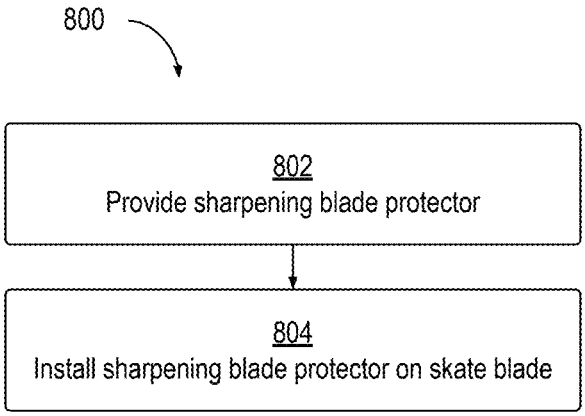
FIG. 8 is a flowchart illustrating an example method of using a skate blade protector, according to one or more implementations herein.

FIG. 8 is a flowchart illustrating an example method 800, according to one or more implementations herein. In some implementations, one or more operations illustrated in FIG. 8 may be performed by one or more of the devices or components depicted in FIG. 1 through FIG. 6, in concert, in the alternative, or in combinations thereof. In some implementations, one or more operations may be performed by another device, system, or group of devices or systems separate from or including these. Additionally, or alternatively other devices, components, or systems, may be employed to perform the operations.

An operation 802 may include providing a skate blade protector and may be performed alone or in combination with one or more other operations depicted in FIG. 8. The skate blade protector may include an outer shell, an inner shell, a magnet disposed therebetween, and a sharpening agent disposed on the inner shell.

An operation 804 may include installing the skate blade of a skate into the inner shell such the sharpening agent contacts the skate blade and may be performed alone or in combination with one or more other operations depicted in FIG. 8.

The invention is limited only by the appended claims. Variations, characteristics, advantages, implementations, constructions, arrangements, terminology, materials, dimensions, embodiments, illustrations, depictions, and examples composing the above description and accompanying drawings show some possible implementations of the invention without limiting the invention. It is not necessary that every implementation of the invention achieve or possess every advantage, purpose, or characteristic identified herein, and as such, one skilled in the art may effect various additions, changes, modifications, or omissions without departing from the scope or spirit of the invention or its legal equivalents.

All ranges are inclusive of the stated limits, the orders of magnitude thereof, and all values and ranges substantially therebetween unless otherwise defined. Unless otherwise stated, every use of "and" forms an inclusive list comprising at least the conjoined elements, and every use of "or" forms an inclusive list comprising at least one element of conjoined elements. Unless otherwise stated, singular usage (e.g., 'a', 'an', or 'the') includes plurals of the same.

The order of recitations in a claim do not imply a temporal or ordered relationship unless unavoidable by the plain language of that claim. No claim may be interpreted to invoke 35 U.S.C. § 112(f) unless that claim recites "means for" or "step for."

What is claimed is:

1. A skate blade protector, comprising:

an outer shell;

an inner shell disposed at least partially within an extent of the outer shell and configured to receive a skate blade of a skate; and a sharpening agent disposed on the inner shell such that after the inner shell receives the skate blade, the sharpening agent contacts the skate blade along at least a majority of the length thereof.

2. The skate blade protector of claim 1, further comprising a magnet disposed between the outer shell and the inner shell.

3. The skate blade protector of claim 1, further comprising a strap secured to the outer shell and configured to wrap around a boot of the skate.

4. The skate blade protector of claim 3, wherein the strap comprises an elastic material.

5. The skate blade protector of claim 1, wherein the inner shell and the outer shell are further defined by a vent hole passage therethrough.

6. The skate blade protector of claim 1, wherein the inner shell comprises woven nylon.

7. The skate blade protector of claim 1, wherein the outer shell comprises a polymer.

8. The skate blade protector of claim 1, wherein the sharpening agent is configured to remove oxidation from the skate blade.

9. The skate blade protector of claim 1, wherein the sharpening agent comprises an abrasive material.

10. The skate blade protector of claim 1, wherein the sharpening agent comprises aluminum oxide.

11. A skate blade protector, comprising:

an outer shell;

an inner shell disposed at least partially within an extent of the outer shell and configured to receive a skate blade of a skate;

a magnet disposed between the outer shell and the inner shell;

a sharpening agent disposed on the inner shell such that after the inner shell receives the skate blade, the sharpening agent contacts the skate blade along at least a majority of the length thereof; and a strap secured to the outer shell and configured to wrap around a boot of the skate;

wherein the inner shell and the outer shell are further defined by a vent passage therethrough.

12. The skate blade protector of claim 11, wherein the strap comprises an elastic material.

13. The skate blade protector of claim 11, wherein the inner shell comprises woven nylon.

14. The skate blade protector of claim 11, wherein the outer shell comprises a polymer.

15. The skate blade protector of claim 11, wherein the sharpening agent is configured to remove oxidation from the skate blade.

16. The skate blade protector of claim 11, wherein the sharpening agent comprises an abrasive material.

17. The skate blade protector of claim 11, wherein the sharpening agent comprises aluminum oxide.

18. A method of using a skate blade protector, comprising:

providing the skate blade protector, including:

an outer shell;

an inner shell disposed at least partially within an extent of the outer shell and configured to receive a skate blade of a skate; and a sharpening agent disposed on the inner shell such that after the inner shell receives the skate blade, the sharpening agent contacts the skate blade along at least a majority of the length thereof; and installing a skate blade of a skate into the inner shell such that the sharpening agent contacts the skate blade.

* * * * *